US007424095B2

(12) United States Patent
Mildner et al.

(10) Patent No.: US 7,424,095 B2
(45) Date of Patent: Sep. 9, 2008

(54) MODULAR X-RAY TUBE AND METHOD OF PRODUCTION THEREOF

(75) Inventors: Mark Joachim Mildner, Rizenbach (CH); Kurt Holm, Baden (CH)

(73) Assignee: Comet Holding AG, Flamatt (CH)

( * ) Notice: Subject to any disclaimer, the term of this patent is extended or adjusted under 35 U.S.C. 154(b) by 106 days.

(21) Appl. No.: 10/581,542

(22) PCT Filed: Dec. 2, 2003

(86) PCT No.: PCT/CH03/00796

§ 371 (c)(1),
(2), (4) Date: Jun. 2, 2006

(87) PCT Pub. No.: WO2005/055270

PCT Pub. Date: Jun. 16, 2005

(65) Prior Publication Data

US 2007/0121788 A1 May 31, 2007

(51) Int. Cl.
*H01J 35/14* (2006.01)
*H01J 35/06* (2006.01)
*H05G 2/00* (2006.01)

(52) U.S. Cl. ..... 378/138; 378/119; 378/136

(58) Field of Classification Search ..... 378/119, 378/136–138, 145
See application file for complete search history.

(56) References Cited

U.S. PATENT DOCUMENTS 3,903,424 A * 9/1975 Rose ..... 250/515.1
6,111,932 A 8/2000 Dinsmore
6,567,500 B2 * 5/2003 Rother ..... 378/140
6,572,426 B1 6/2003 Inazuru (Continued)

FOREIGN PATENT DOCUMENTS

DE 6 946 926 7/1971

(Continued)

OTHER PUBLICATIONS

Wille, Klaus, Physik der Teilchenbeschleuniger und Synchrotronstrahlungsquellen: eine Einfuhrung/von Klaus Wille; Stuttgart: Teubner, 1992, XP-002296527, 2 pages.

*Primary Examiner*—Irakli Kiknadze
(74) *Attorney, Agent, or Firm*—Reising, Ethington, Barnes, Kisselle, P.C.

(57) ABSTRACT

Modular X-ray tube (10) and method for the production of such an X-ray tube, in which an anode (20) and a cathode (30) are arranged in a vacuumized inner space (40) situated opposite each other, electrons ($e^-$) being produced at the cathode (30) and X-rays (y) at the anode (20). The X-ray tube (10) according to the invention comprises a multiplicity of acceleration modules (41, . . . , 45), complementing one another, and each acceleration module (41, . . . , 45) comprises at least one potential-carrying acceleration electrode (20/30/423/433/443). A first acceleration module (41) thereby comprises the cathode (30), a second acceleration module (45) the anode (20). The X-ray tube (10) further comprises at least one other acceleration module (42, . . . , 44). In particular, the X-ray tube according to the invention can possess a re-closeable vacuum valve, enabling individual defective parts of the tube (10) to be replaced in a simple manner or enabling the tube (10) to be modified in a modular way.

20 Claims, 13 Drawing Sheets

U.S. PATENT DOCUMENTS

| | | | |
|---|---|---|---|
| 2002/0014472 | A1 | 2/2002 | Lipperts |
| 2003/0048875 | A1 | 3/2003 | Mihara et al. |

FOREIGN PATENT DOCUMENTS

| | | | |
|---|---|---|---|
| DE | 25 06 841 | A1 | 8/1976 |
| DE | 28 55 905 | A1 | 6/1980 |
| WO | WO 86/05921 | | 10/1986 |

* cited by examiner

MODULAR X-RAY TUBE AND METHOD OF PRODUCTION THEREOF

This application is a 371 of PCT/CH03/00796 of Dec. 2, 2003. The present invention relates to an X-ray tube for high dose rates, a corresponding method for producing high dose rates with X-ray tubes as well as a method of production of corresponding X-ray devices, in which an anode and a cathode are disposed situated opposite each other in a vacuumized inner space, electrons being accelerated to the anode by means of impressible high voltage.

In scientific and technical applications, the use of X-ray tubes is widespread. X-ray tubes not only find application in medicine, e.g. in diagnostic systems or with therapeutic systems for irradiation of diseased tissue, but are also employed e.g. for sterilization of substances such as blood or foodstuffs, or for sterilization (making infertile) of creatures such as insects. Other areas of application are to be further found in classical X-ray technology such as e.g. x-raying pieces of luggage and/or transport containers, or non-destructive testing of workpieces, e.g. concrete reinforcements, etc. Diverse methods and devices for X-ray tubes are described in the state of the art. These range from miniaturized tubes in the form of a transistor housing to high performance tubes with an acceleration voltage of up to 450 kilovolt. Especially in recent times a great deal of time, effort and expense in industry and technology has been put toward improving the capacity and/or efficiency and/or service life and/or maintenance possibilities of systems of irradiation. These efforts have been triggered in particular by new demands relating to security systems, such as e.g. during irradiation of large freight containers in air traffic, etc., and similar devices.

Figure 1:
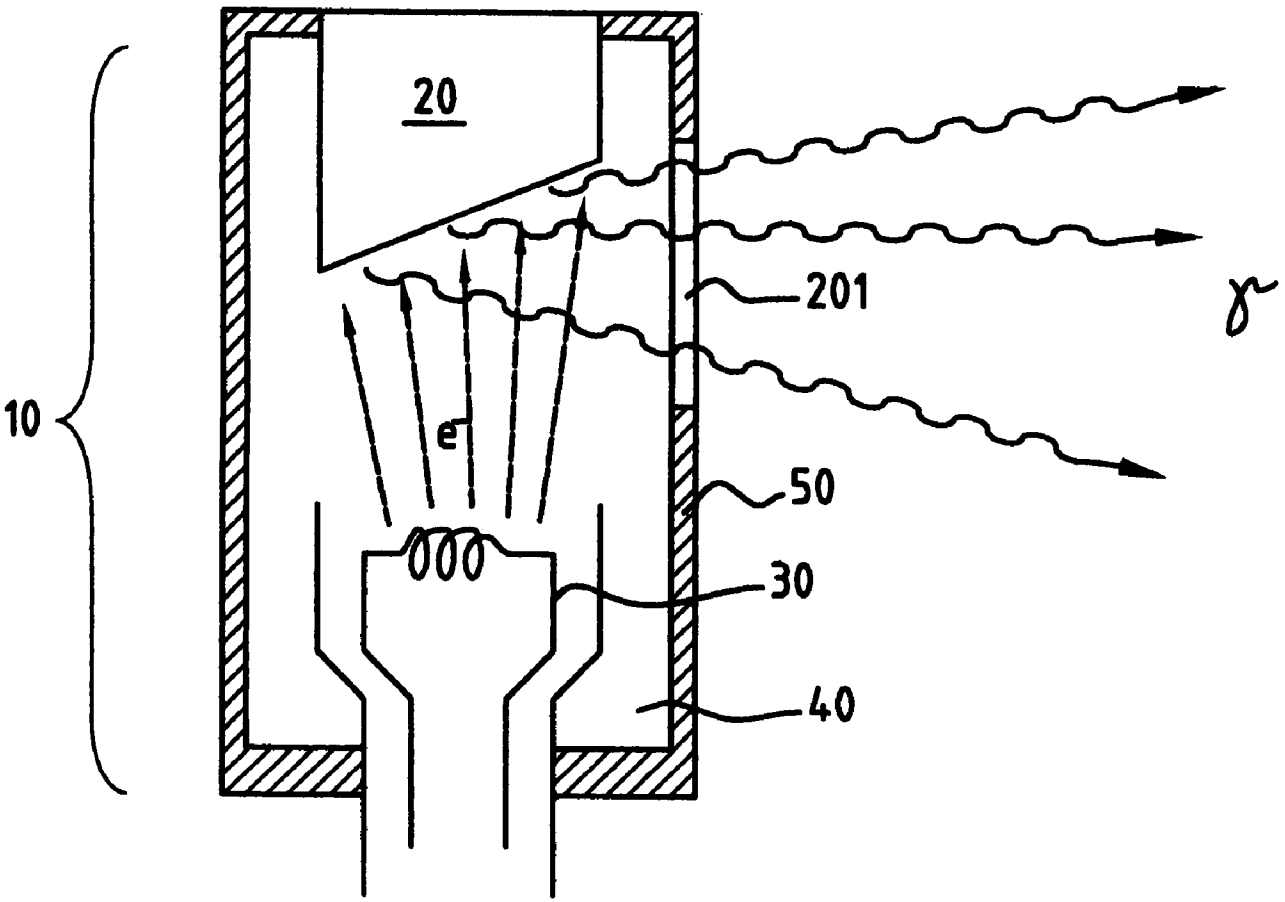
FIG. 1 (PRIOR ART)
Figure 2:
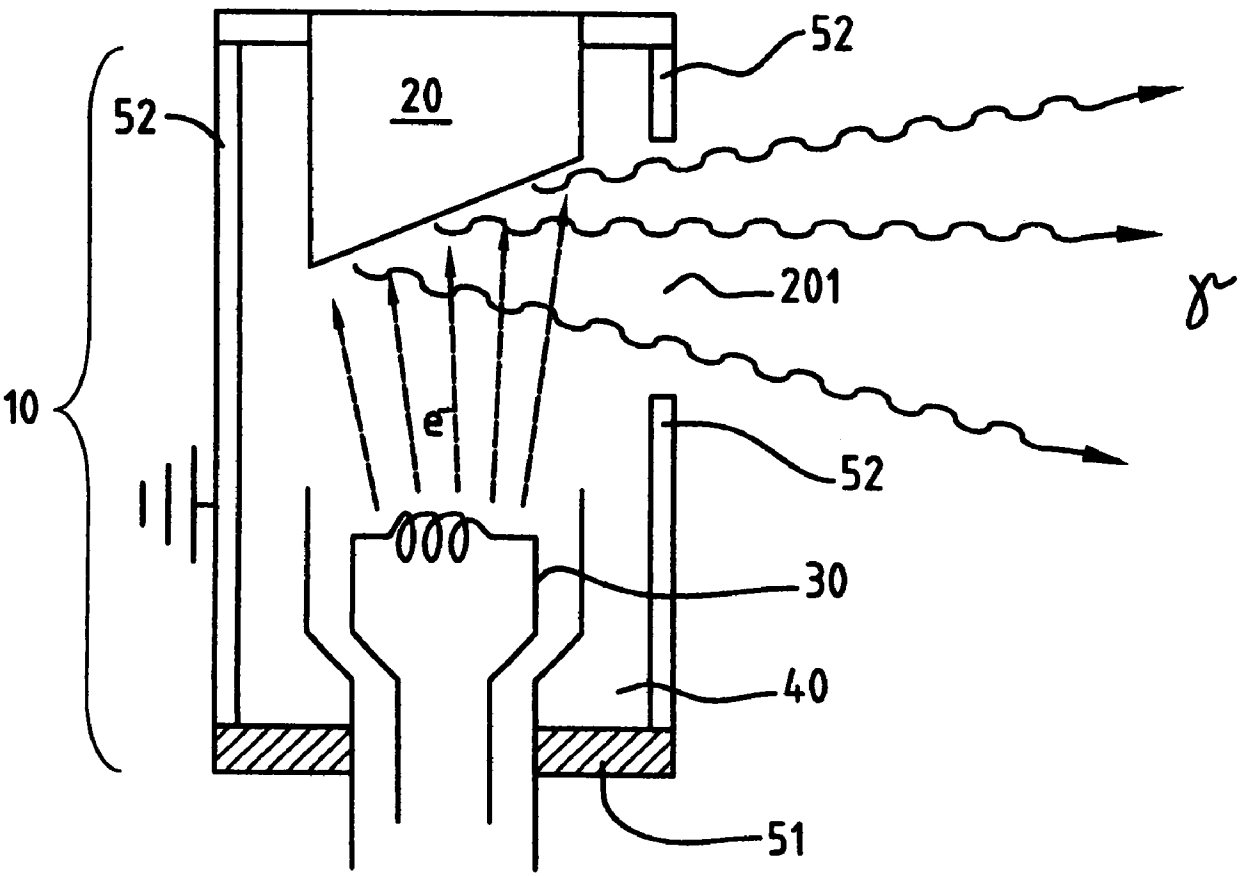
FIG. 2 (PRIOR ART)
Figure 3:
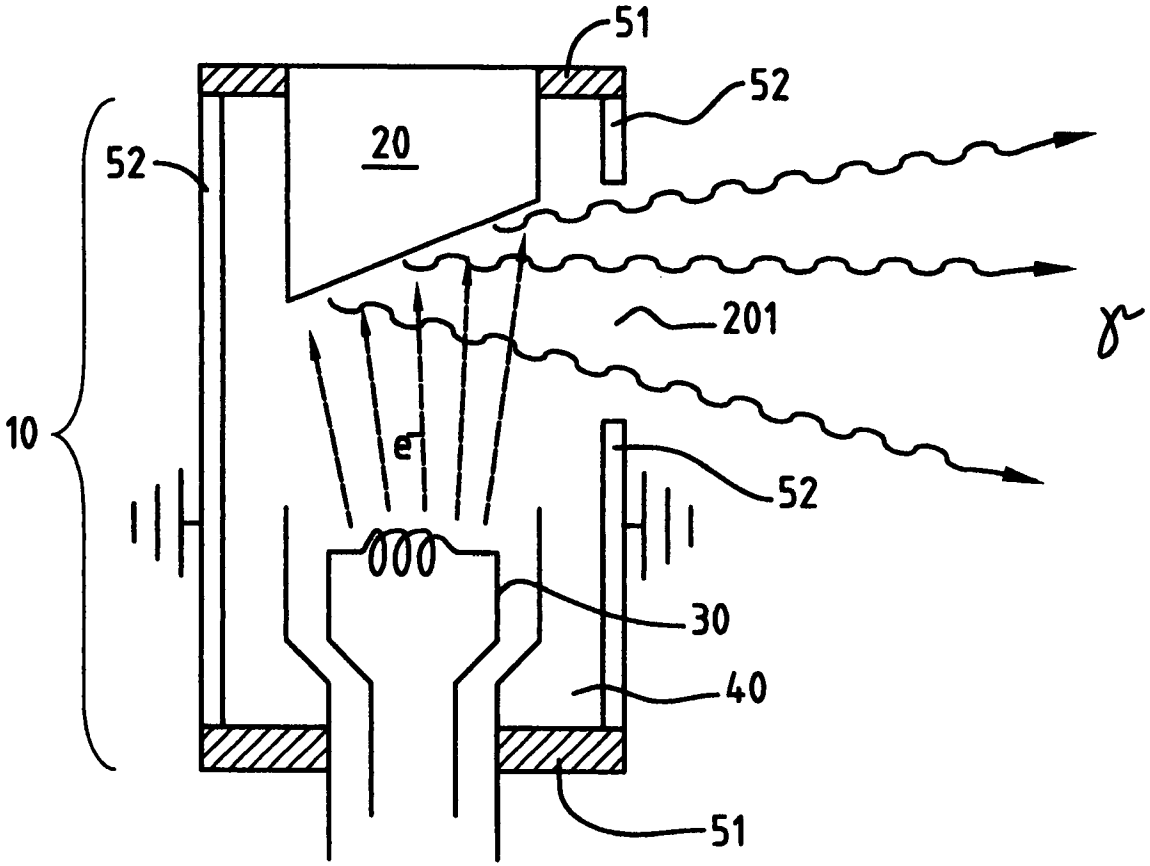
FIG. 3 (PRIOR ART)

The conventional X-ray tube types used in the industrial environment consist either of glass or metal-ceramic composite materials. FIG. 1 shows schematically an example of such a conventional X-ray tube made of a composite glass material. FIGS. 2 and 3 show conventional X-ray tubes made of a composite metal material. In the X-ray tubes, electrons in a vacuumized tube pass through an electrical field. They are thereby accelerated to their ultimate energy, and convert this on a target surface into X-radiation. This means that X-ray tubes comprise an anode and a cathode which are disposed in a vacuumized inner space situated opposite each other, and are enclosed in the metal-ceramic tubes by a cylindrical metal part (FIG. 2/3) and in glass tubes by a glass cylinder (FIG. 1). In glass tubes, the glass acts as insulator. In the metal-ceramic tubes, on the other hand, anode and/or cathode are usually electrically insulated by means of a ceramic insulator, the ceramic insulator or insulators being disposed axially with respect to the metal cylinder, behind the anode and/or cathode, and terminating the vacuum space at the respective end. The ceramic insulators are typically designed discoidal (annular) or conical. In principle, any desired insulator geometry would be possible with this tube type, whereby field superelevations are to be taken into consideration at high voltages. As a rule, the ceramic insulators have an opening at their center in which a high voltage supply to the anode, or the cathode, are inserted in a vacuum-tight way. This kind of X-ray tubes are designated in the state of the art as two-pole or bipolar X-ray tubes (FIG. 3). Distinguished therefrom are so-called unipolar devices (FIG. 2), in which the anode, i.e. the target, is set at ground potential. With the bipolar systems, the electron source (cathode) is set at a negative high voltage (HV), and the target (anode) at a positive high voltage. With all constructions of the state of the art, however, the full acceleration voltage for acceleration of electrons (single stage) is impressed between anode and cathode. It is to be noted that solutions exist in which an aperture located at ground (intermediate aperture) is mounted between anode and cathode. This intermediate aperture can serve, on the one hand, as an electron-optical lens, but also as a mechanical shutter for electrons scattered back from the target.

The problems or the drawbacks that arise from this one-stage construction are owing to the fact that the probability of interfering physical effects grows with increasing impressed voltage. These limit at the present time the X-ray tubes of the state of the art in the case of unipolar tubes to maximally about 200 to 300 kV and in the case of bipolar devices to maximally about 450 kV impressed voltage. As just mentioned, it is the further physical effects, such as e.g. field emission, secondary electron emission, and photo effect, which arise in addition to the desired generation of X rays during operation of an X ray tube, that limit the operational capability of the tubes. Not only do these effects disturb the operation of the X-ray tube, but they can lead to damage of the material and thus to a premature fatigue of the components. In particular, secondary electron emission is known to interfere with X-ray tube functioning. During secondary electron emission, with impingement of the electron beam on the anode, undesired, but unavoidable secondary electrons arise, in addition to the X rays, which secondary electrons move away in the interior of the X-ray tube on paths corresponding to the field lines. Through various scattering and impact methods, these secondary electrons can end up on the insulator surface, and reduce the HV insulation characteristics there. Secondary electrons also arise, however, in that the insulators at the anode and/or cathode are hit during operation by unavoidable filed emission electrons and trigger secondary electrons there. With switched-on high voltage at the anode and cathode, i.e. during operation of the X-ray tube, the electric field is generated in the inner space and at the surfaces turned towards the inner space. This also includes the surfaces of the insulator. The shorter the X-ray tube is and the wider the ceramic insulator is, the greater the probability that secondary electrons and/or field emission electrons impinge on the ceramic part or parts. This results in the high voltage stability and service life of the device being reduced in an undesirable way. With discoidal insulators, therefore, use of so-called shielding electrodes is known from the state of the art, e.g. from DE2855905. The shielding electrodes can be used e.g. in pairs, these being usually disposed coaxially at a certain spacing distance in the case of a rotationally symmetrical design of the X-ray tube, in order to prevent in an optimal way the propagation of secondary electrons. As has been shown, however, such devices can no longer be used with very high voltage. Furthermore the material and manufacturing costs are greater with such constructions than in the case of X-ray tubes having just insulators. Another possibility from the state of the art is shown, for example, in DE6946926. In order to decrease the attack surfaces, a conical ceramic insulator is used in these solutions. The ceramic insulator has a substantially constant wall thickness, and is e.g. covered with a vulcanized rubber layer. The layer is supposed to contribute to secondary electrons arising less intensely. As mentioned, the electric field inside the vacuum space also comprises the surfaces of the insulators. In particular with conical insulators, an electron impinging on the insulators or a stray electron triggered by an impinging electron is accelerated by the field away from the surface in the direction of the anode. In principle, the insulation cones are shaped in such a way that the normal vector of the electric field accelerates the electrons away from the insulator surface. If the anode-side insulator as well as the cathode-side insulator are designed as truncated cone projecting into the inner space, then an electron impinging on the insulator (for example one released from the metal piston) will likewise be accelerated towards the anode. The anode-side cone of the insulator is shaped e.g. such that the normal vector points away from the surface. Anode-side the electron moves along the insulator surface because no electric field pointing away from the insulator surface has an affect upon the electron. After traversing a certain distance, such an electron has sufficient energy to trigger further electrons, which, for their part, release in turn electrons, so that there arises on the insulator surface an electron avalanche toward the anode, which can cause a significant malfunction, in certain circumstances also gas eruptions or even a breakdown of the insulator. The higher the voltage is, the more significant this effect becomes. With very high voltages, this kind of insulator can therefore be no longer used. Moreover it is to be noted that the geometric length grows with increasing applied electric field. Depending upon energy and angle of emission, electrons can also run in the direction of the cathode, in particular in the case of stray or scatter electrons. Cathode-side the effect described above occurs less frequently, since electrons which end up on the insulator surface cathode-side or are released therefrom, move through the vacuum in the direction of the metal cylinder and not along the insulator surface. To get around the disadvantage, various solutions are known in the state of the art; for example, proposed in the unexamined German publication DE2506841 is to design the insulator cathode-side such that a conical hollow space exists between the insulator and the tube. Another solution of the state of the art is shown e.g. in the patent publication EP0215034, where the discoidal insulator is tiered in a stepped way toward the metal cylinder. It has been shown, however, that all the solutions shown in the state of the art have malfunctions at high voltages, i.e. for instance above 150 kV, which lead to a premature aging of the material, among other things, and can cause gas eruptions and/or breakdown of the insulator. Thus the X-ray tubes known in the state of the art are poorly suited, or not usable at all, for many modern applications with very high voltages (>400 kV).

It is an object of this invention to propose a new X-ray tube and a corresponding method of production of such an X-ray tube not having the drawbacks described above. In particular, an X-ray device should be proposed allowing electric powers several times higher than conventional X-ray devices. The tubes should also be able to be constructed modularly, and be produced simply and economically. Furthermore any possible defective parts of the X-ray tube should be replaceable without the whole X-ray tube having to be replaced.

This object is achieved according to the present invention in particular through the elements of the independent claims. Further advantageous embodiments follow moreover from the dependent claims and from the specification.

These objects are achieved in particular through the invention in that an anode and a cathode are disposed opposite each other in a vacuumized inner space in an X-ray tube, electrons being produced at the cathode, being accelerated to the anode by means of impressible high voltage, and X rays being produced at the anode by means of the electrons, the X-ray tube comprising a multiplicity of mutually complementary acceleration modules, which acceleration modules each comprise at least one potential-carrying electrode, the first acceleration module comprising the cathode with primary electron generation, and the last acceleration module comprising the anode with the X-ray generation, and the X-ray tube comprising at least one further acceleration module with a potential-carrying electrode, which acceleration module is connectible in series in a repeatable way as often as desired for acceleration of electrons, and the X-ray tube being of modular construction. The anode can comprise a target for X-ray generation with an emission hole, or can be designed as a transmission anode, in the case of the transmission anode the vacuumized inner space of the X-ray tube being closed off toward the outside. At least one of the electrodes can comprise spherical or conical ends for reducing or minimizing the field peak at the respective electrode. The electrodes can be connected, for example, with a high voltage cascade, e.g. by means of voltage connections. One advantage, among others, of the invention is that very high power X-radiation can be generated, the overall geometric size of the X-ray tube being small, in particular compared with tubes of the state of the art, and at the same time the invention makes possible an X-ray tube which is able to be operated in a stable manner over a very broad electrical voltage range without performance characteristics changing. A further advantage of the invention, among others, is a by far more minimal stress on the insulator from the E- field. This applies in particular when compared with the conventional discoidal insulators. The X-ray tube according to the invention can be produced e.g. in a one-shot method, the soldering of the entire tube taking place in a one-step vacuum soldering process. This has in particular the advantage that the subsequent evacuation of the X-ray tube by means of high vacuum pump can be omitted. It is a further advantage that the X-ray tube according to the invention, owing to its simple and modular construction, is especially well suited to the one-shot method since the fields inside the tube are much smaller than in the case of conventional tubes, and the tube according to the invention is thereby less vulnerable to impurities and/or leaks.

In an embodiment variant, the difference in potential between two potential-carrying electrodes each of adjacent acceleration modules is selected to be constant for all acceleration modules, the final energy of the accelerated electrons ($e^-$) being a whole-number multiple of the energy of an acceleration module. This embodiment variant has the advantage, among others, that the stress on the insulators is constant over the path, and no field peaks occur that could have a disadvantageous effect upon the operating ability of the tube.

In another embodiment variant, at least one of the acceleration modules has a reclosable vacuum valve. The acceleration modules can thereby be provided with a vacuum seal on one side or on both sides in order to permit an air-tight closure between the individual acceleration modules. This embodiment variant has the advantage, among others, that by means of the vacuum valve individual parts of the X-ray tube can be replaced without the entire tube having to be replaced, as in the case of conventional X-ray tubes. Since the tube is of modular construction, the tube is able to be subsequently adapted to changed operational requirements without any difficulty by further acceleration modules being inserted or existing modules removed. This is not possible in this way with any of the tubes of the state of the art.

In a further embodiment variant, the acceleration modules contain a cylindrical ceramic insulator. This embodiment variant has the advantage, among others, that in the case of moderate stress from the electric field, the mechanical, design-engineering effort is minimal, extraordinarily high performance characteristics being attainable.

In another embodiment variant, the ceramic insulator has a high-ohmic interior coating. This embodiment variant has the advantage, among others, that disruptive charging by scattered electrons, provoked on the one hand by field-related processes in the insulator material, on the other hand by secondary electrons scattered back from the anode target and by field emission electrons, is avoided. The service life of the X-ray tubes and/or the differences in potential between the individual acceleration electrodes can thereby be further increased.

In an embodiment variant, the ceramic insulator 53 comprises a ridged exterior structure. Through the shape of the ceramic insulator 53, the insulating section on the exterior (atmospheric side) of the insulator can be lengthened. This embodiment variant has the advantage, among others, that it has an exterior structure suitably shaped for the high voltage. This exterior structure enables moreover an improved, more efficient cooling of the X-ray tube.

In an embodiment variant, the electrodes of the acceleration modules include a shield for suppression of the stray electron flow on the ceramic insulator. At least one of the shields can comprise spherically or conically designed ends for reducing or minimizing the field peak at the respective shield. This embodiment variant has the advantage, among others, that the shields constitute supplementary protection for the ceramic insulator. The service life of the X-ray tubes and/or the differences in potential between the individual electrodes can thereby be further increased.

In an embodiment variant, the X-ray tube according to the invention is produced in a one-shot method. This has the advantage, among others, that the subsequent evacuation of the X-ray tube 10 by means of high vacuum pump can be omitted. A further advantage of the one-shot method, i.e. the one-step manufacturing process by total soldering of the tube in the vacuum (one-shot method), is, among others, that one has a single manufacturing process, and not three, as in the conventional way: 1. soldering of components /2. joining together of components (e.g. soldering or welding)/3. evacuating tube by means of vacuum pump. The one-step production method is thus economically more efficient, time-saving, and cheaper. At the same time, with suitable process control, contamination of the tube can be minimized with this method. Anyhow it can be advantageous when the tube is free of impurities to a large extent that, as a rule, minimize the ceramic insulator's ability to withstand voltage. The requirements with respect to vacuum tightness for the tubes 10 are in most cases the same with one-shot methods as with multi-step manufacturing processes.

It should be stated here that besides the method according to the invention, the present invention also relates to a device for carrying out this method as well as a method of production of such a device. In particular it also relates to irradiation systems comprising at least one X-ray tube according to the invention with one or more high voltage cascades for voltage supply of the at least one X-ray tube.

Embodiment variants of the present invention will be described in the following with reference to examples. The examples of the embodiments are illustrated by the following attached figures:

FIG. 1 shows a block diagram representing schematically an X-ray tube 10 made of a glass compound of the state of the art. Electrons $e^-$ are thereby emitted from a cathode 30, and X rays γ emitted from an anode 20, through a hole 201. 50 is a cylindrical glass tube, the glass serving as insulator.

FIG. 2 shows a block diagram representing schematically a unipolar X-ray tube 10 made of a metal-ceramic compound of the state of the art. 51 is the ceramic insulator, 52 the metal cylinder put on ground. Electrons $e^-$ are thereby emitted from a cathode 30, and X rays γ emitted from an anode 20, through a hole 201.

FIG. 3 shows a block diagram representing schematically a bipolar X-ray tube 10, likewise made of a metal-ceramic compound of the state of the art. 51 is the ceramic insulator, 52 the metallic cylinder put on ground.

Electrons $e^-$ are thereby emitted from a cathode 30, and X rays γ from an anode 20, through a hole 201.

Figure 4:
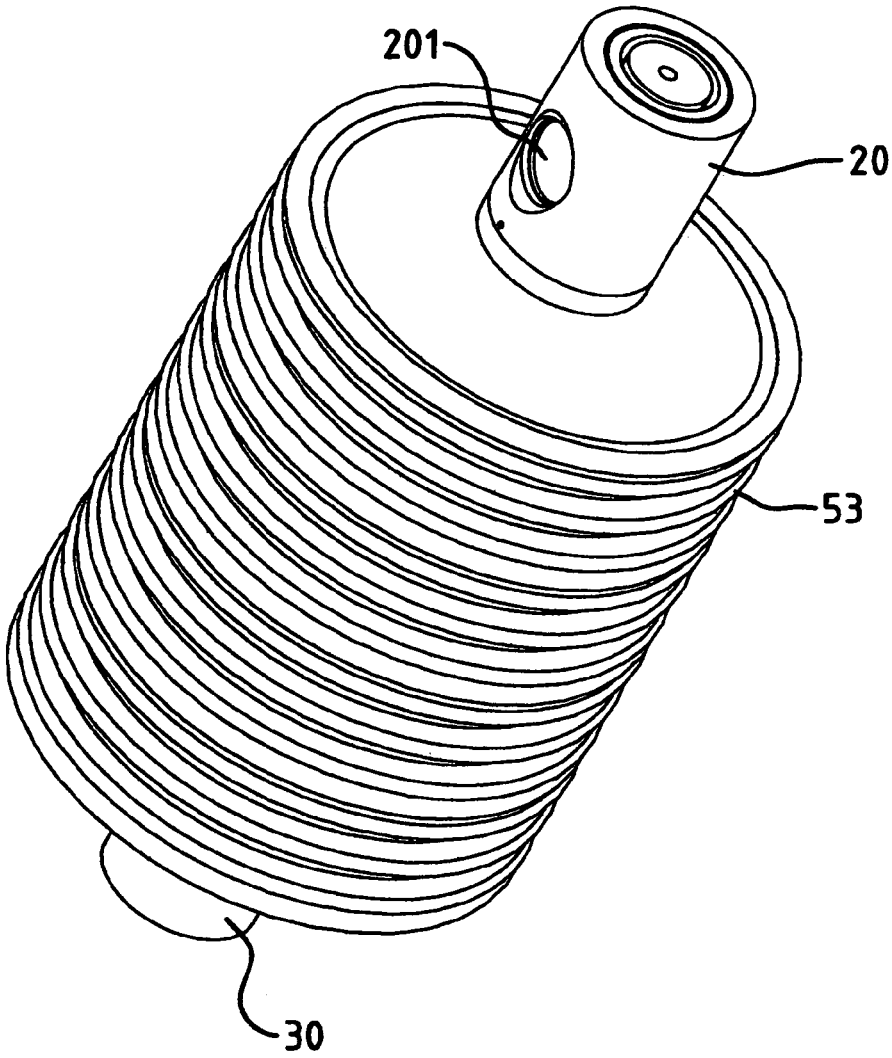

FIG. 4 shows a block diagram, representing schematically an example of an external view of an X-ray tube 10 according to the invention.

Figure 5:
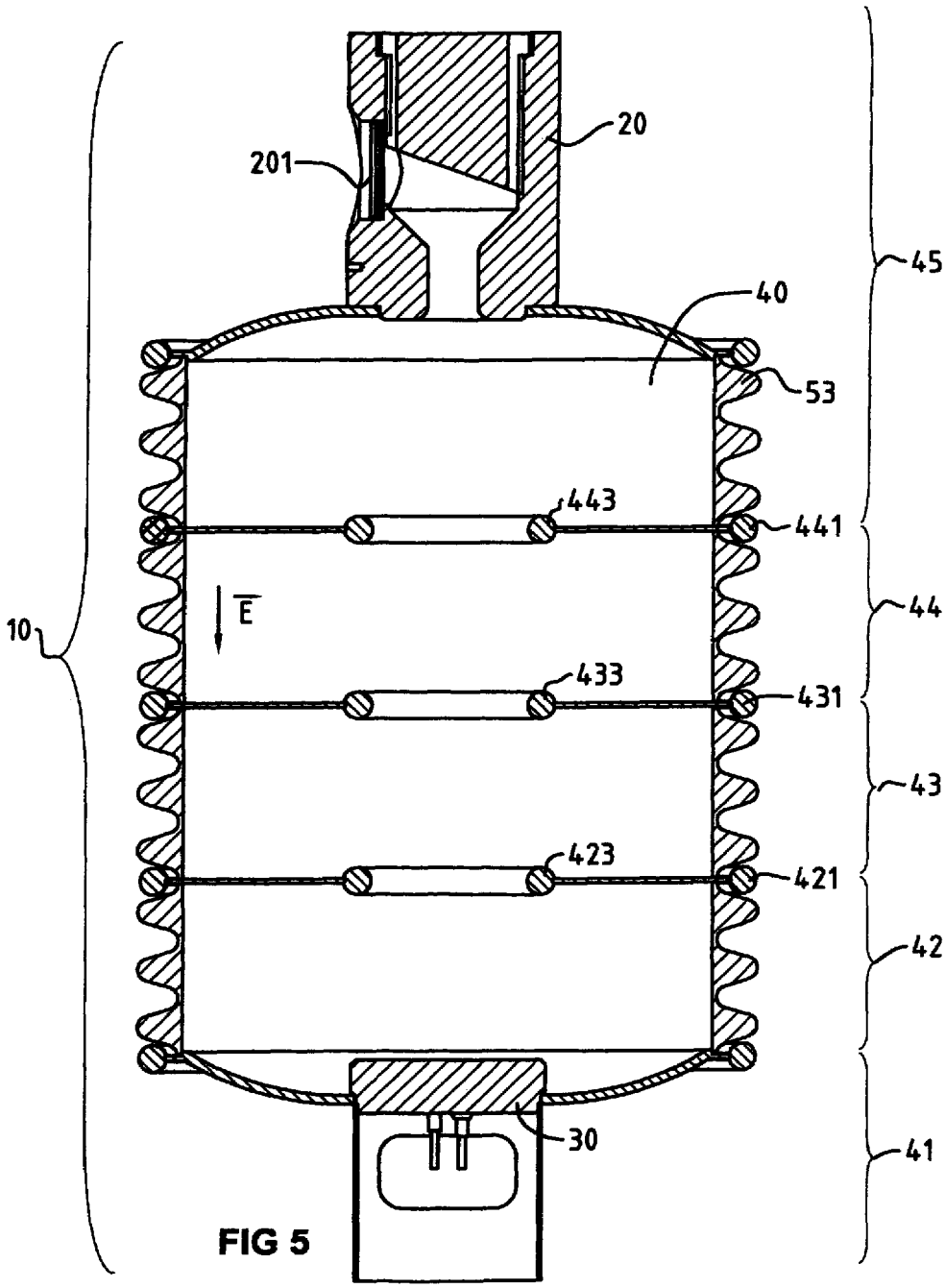

FIG. 5 shows a block diagram representing schematically the architecture of an embodiment variant of an X-ray tube 10 according to the invention. Electrons $e^-$ are thereby emitted from a cathode 30, and X rays γ are emitted from an anode 20. The X-ray tube 10 comprises a plurality of mutually complementary acceleration modules 41, . . . , 45, and each acceleration module comprises at least one potential-carrying electrode 20/30/423/433/443.

Figure 6:
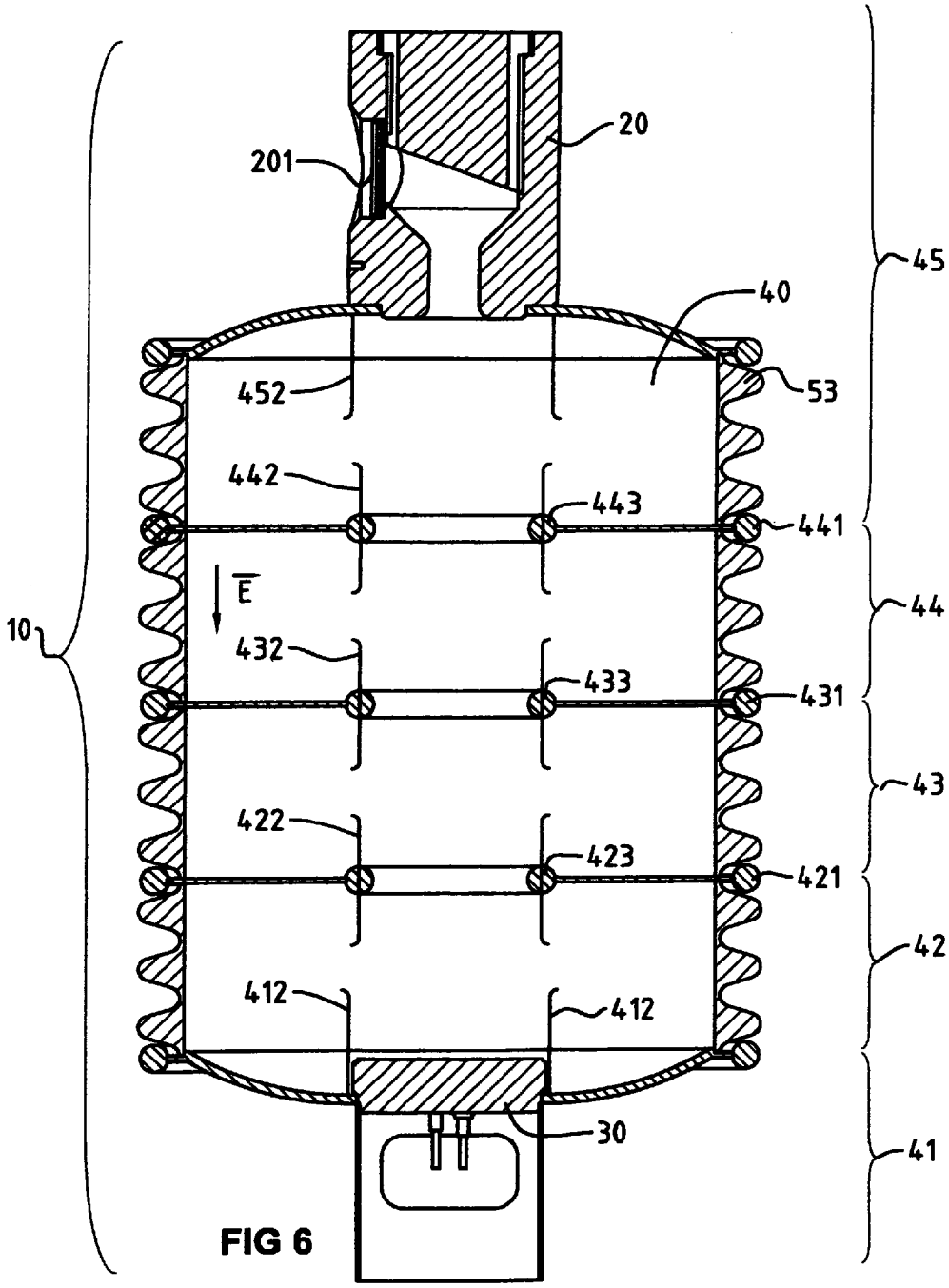

FIG. 6 shows a block diagram, representing schematically the architecture of a further embodiment variant of an X-ray tube 10 according to the invention. As in FIG. 3, the X-ray tube 10 comprises a plurality of mutually complementary acceleration modules 41, . . . , 45 with voltage-carrying electrodes 20/30/423/433/443. The acceleration modules comprise in addition electron shields 422/432/442 for suppression of the stray electron flow on the 20 ceramic insulator.

Figure 7:
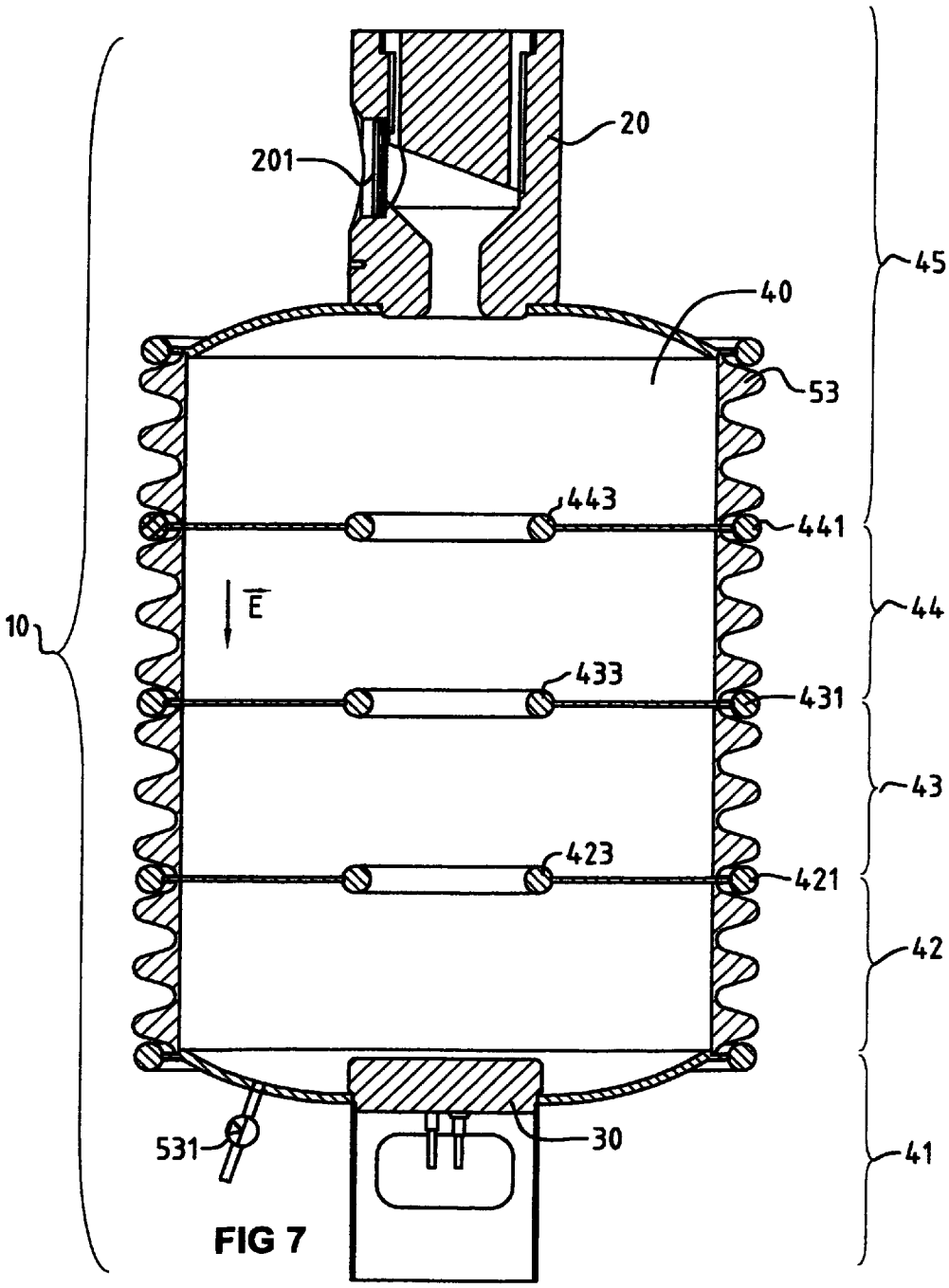

FIG. 7 likewise shows a block diagram representing schematically the architecture of another embodiment variant of an X-ray tube 10 according to the invention. As in FIG. 3, the X-ray tube 10 comprises a plurality of mutually complementary acceleration modules 41, . . . , 45 with voltage-carrying electrodes 20/30/423/433/443. At least one of the acceleration modules 41, . . . , 45 comprises in addition a reclosable vacuum valve 531.

Figure 8:
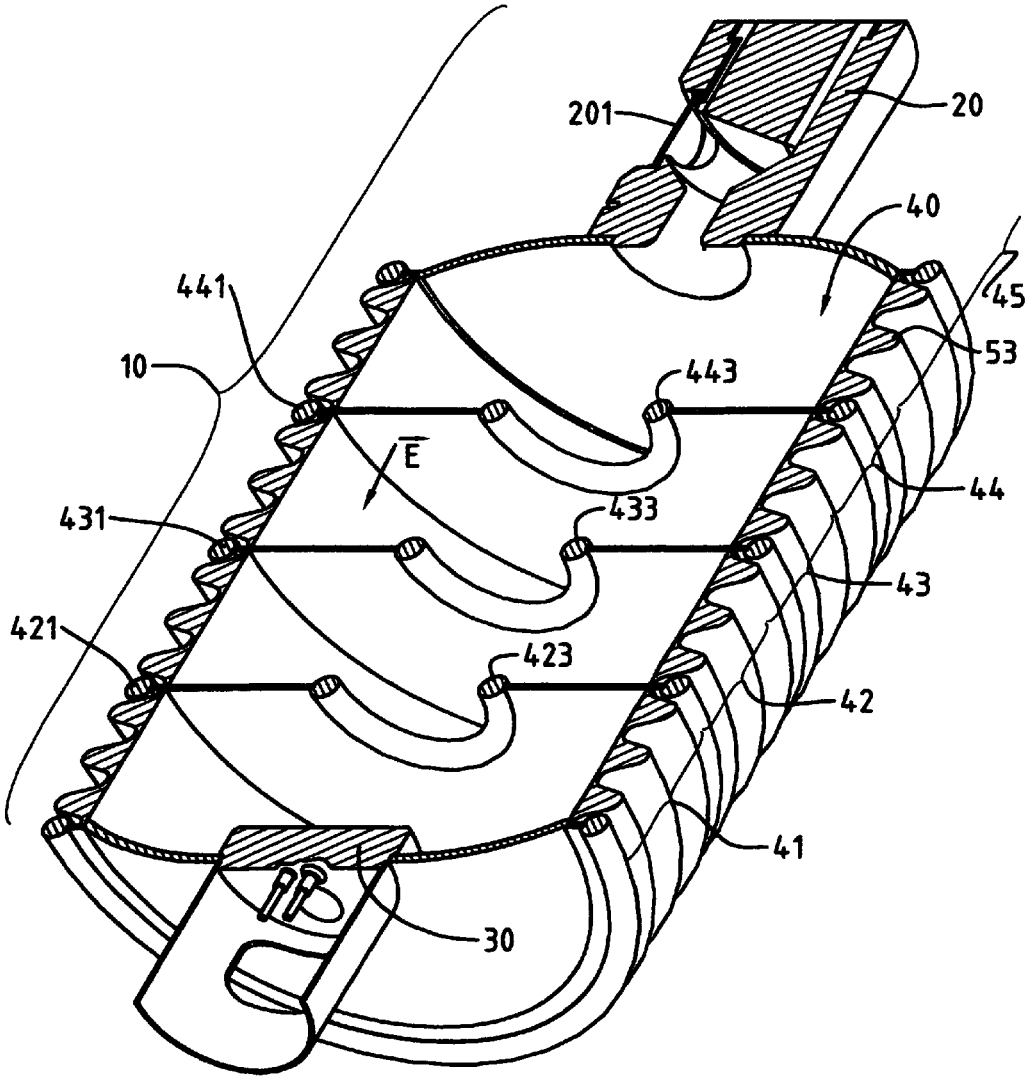

FIG. 8 shows a cross section of an X-ray tube 10 according to the invention, representing schematically the architecture of an embodiment variant according to FIG. 3.

Figure 9:
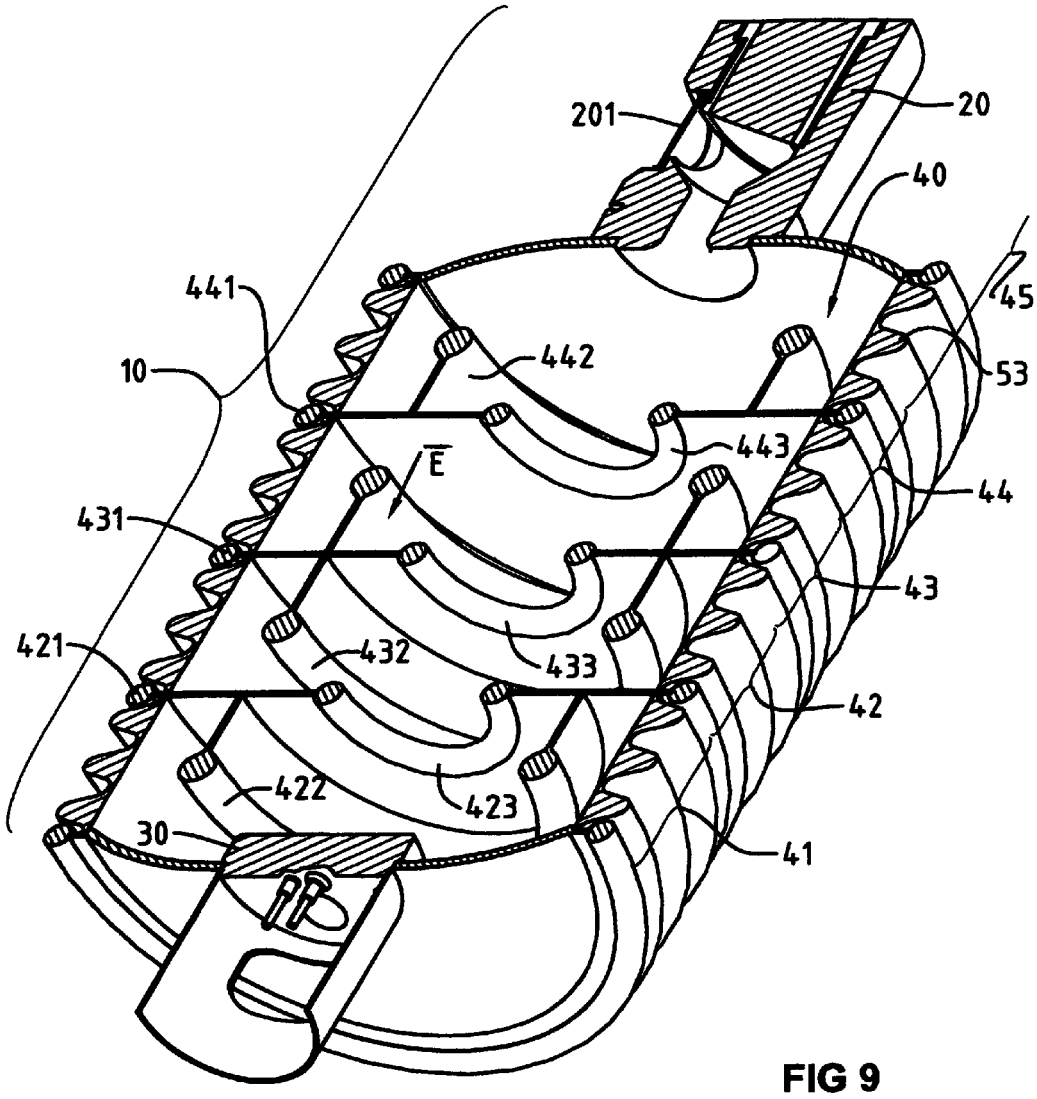

FIG. 9 shows another cross-sectional view of an X-ray tube 10 according to the invention. The acceleration modules 41, . . . , 45 comprise additionally a possible embodiment for shields 423 . . . 443 for suppression of the stray electron flow on the ceramic insulator. This embodiment variant has the advantage, among others, that the shields constitute supplementary protection for the ceramic insulator. The service life of the X-ray tubes and/or the difference in potential between the individual acceleration electrodes can thereby be further increased. The possible embodiment of FIG. 9 shows spherically or conically designed ends of the electrodes 423/433/443 and/or of the shields 412, 422, 432, 442 and 452 for reducing or minimizing the field peak at the respective electrode 423/433/443 and/or shields 412, 422, 432, 442 and 452. The electrodes 423/433/443 are connectible by voltage connections, e.g. to a high voltage cascade.

Figure 10:
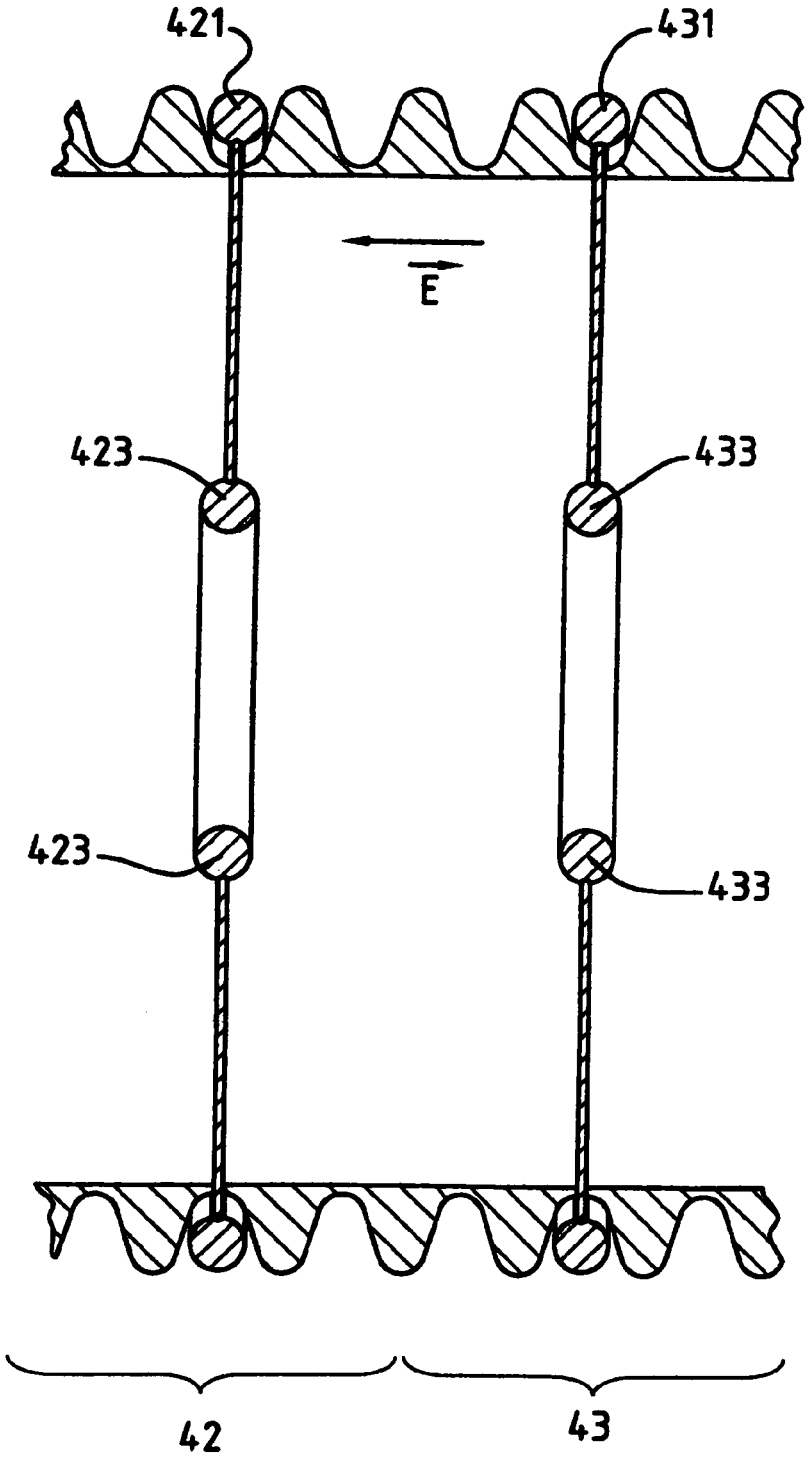

FIG. 10 shows the principle structure of an acceleration stage of a modular metal-ceramic tube with a modular two-step acceleration phase with two acceleration modules 42/43 with ceramic insulator 50, acceleration electrodes 423/433 and voltage connections 421/431.

Figure 11:
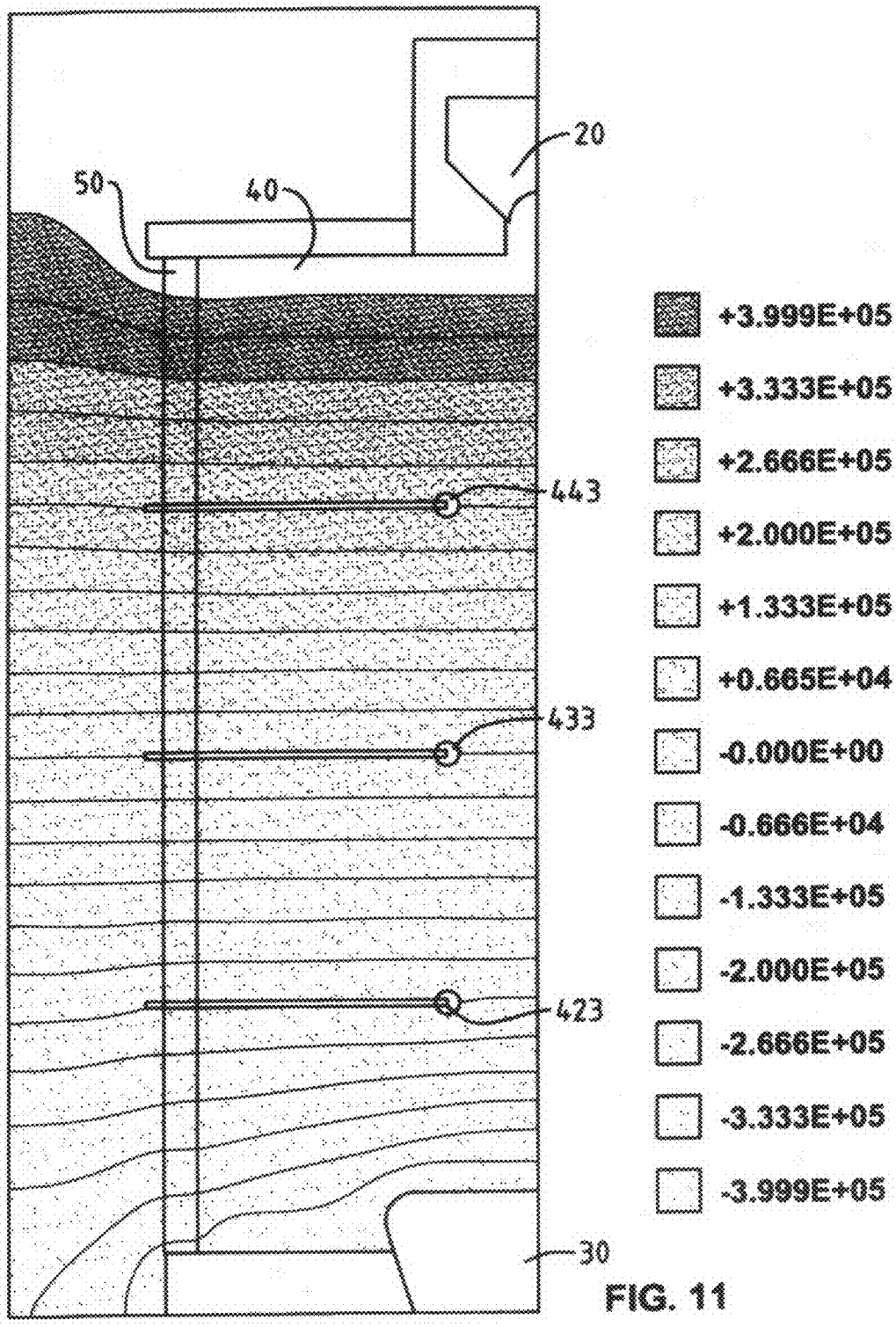

FIG. 11 shows schematically the potential distribution in a modular X-ray tube 10 according to the invention from an embodiment example with a 800 kV tube.

Figure 12:
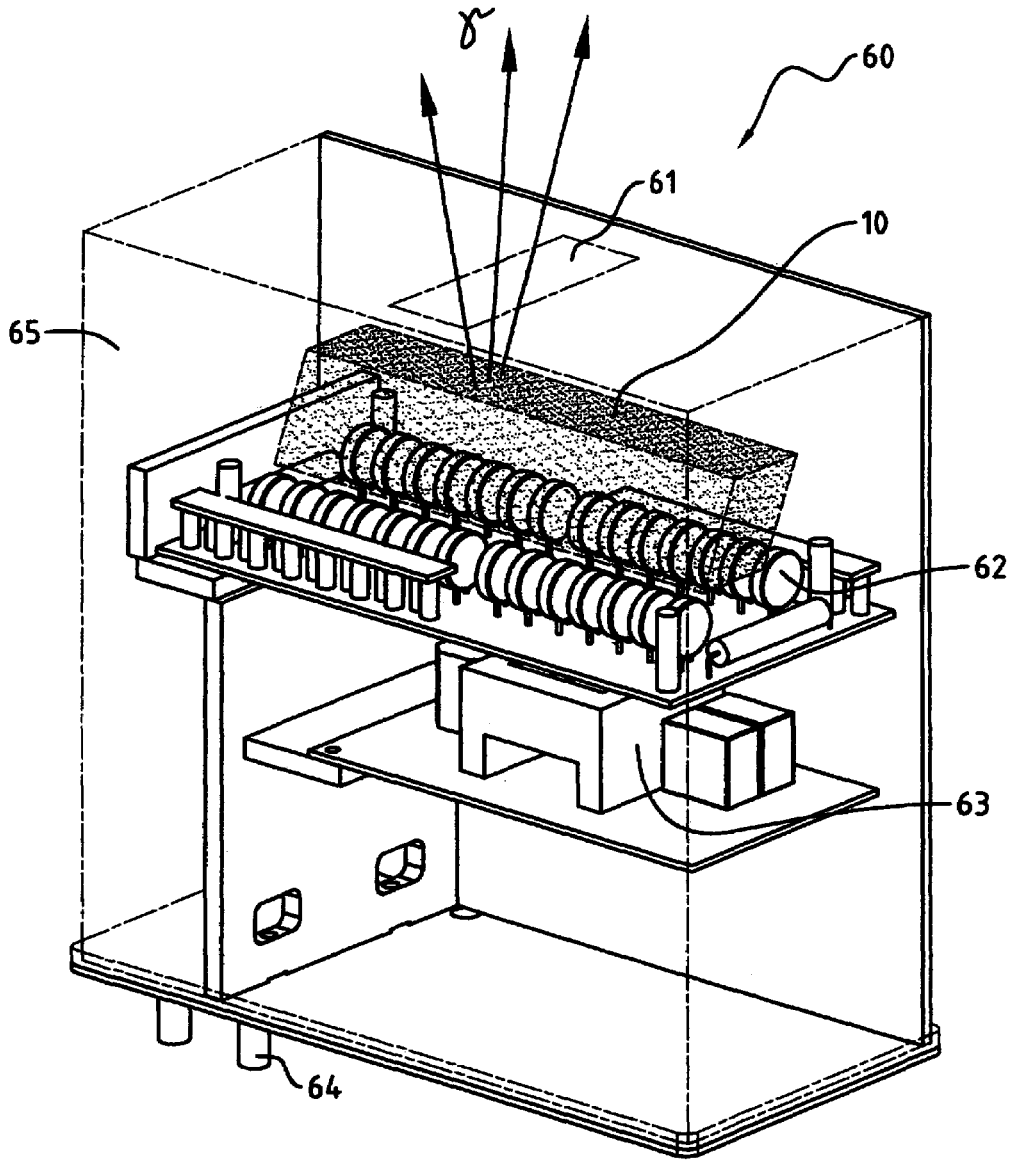

FIG. 12 shows schematically an irradiation system 60 with an X-ray tube 10 according to the invention. The irradiation system 60 comprises a high voltage cascade 62 for voltage supply of the X-ray tube 10, a high voltage transformer 63 as well as an emission hole 61 for X-radiation γ out of the shield housing 65.

Figure 13:
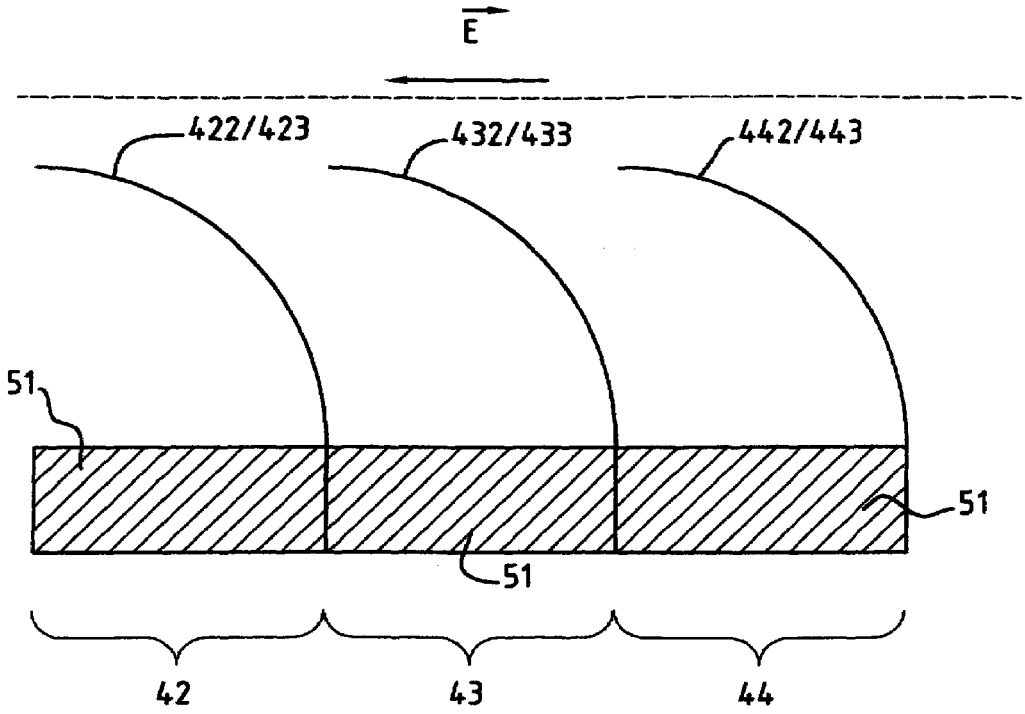

FIG. 13 shows a further embodiment variant of three acceleration modules 42/43/44 with ceramic insulator 50, electron shield 422/432/442 and acceleration electrodes 423/433/443.

FIG. 4 to 10 illustrate architectures as they can be used to achieve the invention. In these embodiment examples for a modular X-ray tube 10, an anode 20 and a cathode 30 are disposed opposite each other in a vacuumized inner space 40. The electrons $e^-$ are generated at the cathode 30, the cathode 30 serving as electron emitter. The cathode 30 thus serves the purpose, on the one hand, of generation of the electric field E, but, on the other hand, also the purpose of electron generation. Thus in principle all materials which can emit the electrons $e^-$ are suitable for this application. This process can be achieved through thermal emission, but also through field emission (cold emission). Used as cold emitters can be e.g. any kind of micro-tip arrays with usually diamond-like structures or e.g. also nano tubes. Of course cold emission can also be used with this tube type by using the Penning Effect on suitably formed metals. For instance, thermal emitters can be used that are also usable with this emitter concept, such as e.g. tungsten (W), lanthanum hexaboride ($LaB_6$), dispenser cathodes (La in W) and/or oxide cathodes (e.g. ZrO). The electrons $e^-$ are accelerated to the anode 20 by means of impressible high voltage, and generate X rays γ on a target surface of the anode 20. The anodes 20 fulfil two functions in the X-ray tubes 10. On the one hand they serve as positive electrode 20 for generation of an electric Field E for acceleration of the electrons $e^-$. On the other hand, the anodes 20, or respectively the target material embedded in the anodes 20, serve as the place where the electron energy is converted into X-radiation γ. This conversion is, on the one hand, dependent on the particle energy, but also on the atomic number of the target material. In a first approximation, according to the Bethe formula, the energy loss of the particles is equal to the square of the atomic number Z of the target material $$dW/dx \approx Z^2$$

With this process the anode 20 is thermally stressed. The anode or respectively the target material must therefore be able to withstand this thermal stress. It follows therefrom that the vapor pressure of the target material should be sufficiently low at operating temperature of the target in order not to influence in a negative way the vacuum necessary for operation of the X-ray tube 10. Thus target materials may preferably be used which are high-temperature-resistant or can be well cooled. For this purpose the target material can be embedded in a good material capable of conducting heat (e.g. copper), which is able to be well cooled, i.e. conducts heat well. For example, materials as heavy and temperature-resistant as possible can therefore be used as anode (target) 20. In particular, suitable therefor are e.g. materials such as tungsten (W, Z=74) and/or uranium (U, Z=92) and/or rhodium (Rh, Z=45) and/or silver (Ag, Z=47) and/or molybdenum (Mo, Z=42) and/or palladium (Pd, Z=46) and/or iron (Fe, Z=26) and/or copper (Cu, Z=29). In selecting the target material, it can be particularly advantageous, e.g. for analytical applications, to take into consideration that the characteristic lines ($K_\alpha$) are suitable for the specific application purpose.

The X-ray tube 10 further comprises a plurality of mutually complementary acceleration modules 41, . . . , 45. Each acceleration module 41, . . . , 45 comprises at least one potential-carrying electrode 20/30/423/433/443 with the corresponding voltage connections 421/431/441. A first acceleration module 41 comprises the cathode 30 with the electron generation $e^-$, i.e. with the electron emitter. A second acceleration module 45 comprises the anode 20 with the X-radiation γ. The X-ray tube comprises at least one further acceleration module 42, . . . , 44 with a potential-carrying electrode 423/433/443. The vacuumized inner space 40 can be closed off toward the outside e.g. by means of ceramic insulator 51. For the emission concept according to the invention, insulation materials can be used, for example, which satisfy the electric requirements of the X-ray tube 10 (field strength). For corresponding embodiment examples, the insulation materials should also be suitable for producing a metal-ceramic compound. In addition, the ceramic should be usable for high vacuum applications. Thus suitable materials are, for example, pure oxide ceramics, such as aluminum oxide, magnesium oxide, beryllium oxide and zirconium oxide. Also monocrystalline $Al_2O_3$ (sapphire) is in principle suitable. Furthermore so-called glass ceramics, such as e.g. Macor®, or similar materials are conceivable. In particular, composite ceramics are of course also suitable (e.g. doped $Al_2O_3$), if they have the respective characteristics. The insulation ceramics 51 can be designed e.g. outwardly ridged, or in a similar way, in order to lengthen the insulation section of the insulation jacket 51 that is not vacuum-side, i.e. is situated in insulating oil. In the same way, however, any other design of the ceramic insulator 51, e.g. a pure cylindrical form, is conceivable, without affecting the core of the invention. The ceramic insulator 51 can have in addition e.g. a high-ohmic interior coating in order to divert possible charges which can be caused by various electronic processes, it being ensured at the same time that the acceleration voltage is able to be impressed. FIG. 8 shows the principle structure of a modular metal-ceramic tube of two such further acceleration modules 42/43 with ceramic insulator 51, acceleration electrodes 423/433 and potential connections 421/431. The principle described here for construction of X-ray tubes 10, being composed e.g. of a metal-ceramic compound, can be series-connected according to the invention as often as desired, and can thus be used for acceleration of electrons $e^-$ (multi-phase acceleration). The last potential-carrying electrode of the acceleration structure is the anode 20, necessary for generation. On the other hand, the cathode 30, necessary for electron generation, represents the first electrode of the acceleration structure. This is shown in the embodiment examples of FIGS. 4 to 9. With suitable configuration and selection of the electrodes, X-ray tubes 10 with a total energy of up to 800 kilovolt or more can be built (e.g. FIG. 5). In contrast, conventional X-ray tubes until now have been able to be produced with a total energy of 200 to 450 kilovolt. A significant advantage of this concept is that very high energies are achieved with at the same time small structural shapes. A further advantage over existing designs is the nearly homogeneous stressing of the segments of the ceramic insulator 51 by the electric field. This has the advantage, among others, that the X-ray tube 10 can be configured through segmentation such that the field-related stressing of the ceramic insulators 51 remains below a threshold needed for high voltage spark over. FIG. 9 shows schematically the potential distribution in a modular X-ray tube 10 according to the invention in an embodiment example with a 800 kV tube. With the X-ray tubes used in the state of the art, on the other hand, large-scale radial stresses on the ceramic insulators often occur since the tubes are essentially constructed in a way similar to a cylindrical capacitor. These radial fields lead to very high field intensities at the interface between the insulator internal radius and the axially disposed acceleration electrodes (anode, cathode). Owing to this enormous field peak at the so-called triple point (insulator-electrode-vacuum) field emissions of electrons often result, which generate high voltage spark-overs and can lead to destruction of the tube, as has already been described further above. FIG. 1 shows schematically an architecture of such a conventional X-ray tube 10 of the state of the art. Electrons $e^-$ are thereby emitted from an electron emitter, i.e. a cathode 20, as a rule a hot tungsten coil, are accelerated toward a target through an impressed high voltage, X rays γ being radiated from the target, i.e. the anode 30, through a hole 301. Triple points (field peaks which lead to field emission of electrons $e^-$) occur thereby both cathode-side as well as anode-side.

The difference in potential between each two potential-carrying electrodes 20/30/423/433/443 of adjacent acceleration modules 41, . . . , 45 can be selected to be constant e.g. also for all acceleration modules 41, . . . , 45, the final energy of the accelerated electrons $e^-$ being a whole number multiple of the energy of an acceleration module 41, . . . , 45. At least one of the acceleration modules 41, . . . , 45 can further comprise a reclosable vacuum valve 531. This has the advantage that by means of vacuum valve 531 individual parts of the X-ray tube 10 can be replaced without at the same time the entire tube having to be replaced as with conventional X-ray tubes. Since the tube 10 according to the invention is of modular construction, the tubes 10 are thus able to be subsequently adapted without any problems to changed operating requirements in that further acceleration modules are used or existing modules removed. This is not possible in this way with any of the tubes in the state of the art.

It is important to point out that with the X-ray tubes 10 according to the invention a modularity in principle exists, i.e. the increase in the radiance energy of an X-ray tube 10 can be achieved by adding one or more acceleration segments 41, . . . ,45 or acceleration modules 41, . . . , 45. At least one of the acceleration modules 41, . . . , 45 can thereby be constructed such that it bears a reclosable vacuum valve. The acceleration modules 41, . . . , 45 can further comprise vacuum seals on one side or on both sides. This has the advantage that individual defective acceleration modules 41, . . . , 45 can be simply replaced and/or recycled by a defective tube 10 being devacuumized using the reclosable vacuum valve 531, the defective acceleration module 41, . . . , 45 being replaced by a new and/or functioning one, and the tube 10 being vacuumized again using a corresponding vacuum pump via the reclosable vacuum valve 531. It is also important to point out that the electrodes 20/30/423/433/443 of the acceleration modules 41, . . . , 45 can comprise a shielding 412, 422, 432, 442 and 452 for suppression of the stray electron flow on the ceramic insulator 51 (FIG. 6/13). This has the advantage that the shields constitute supplementary protection for the ceramic insulators 51. The service life of the X-ray tubes and/or the difference in potential between the individual acceleration electrodes 20/30/423/433/443 can thereby be further increased. The simple and modular construction of the X-ray tube 10 according to the invention is especially well suited to a manufacturing process with a one-shot method, or respectively this design makes possible in principle the one-shot method in an efficient way. The soldering of the entire tube 10 takes place thereby in a one-step vacuum soldering process. This has the advantage, among others, that the subsequent evacuation of the X-ray tube 10 by means of high vacuum pump can be omitted. A further advantage of the one-shot method, i.e. of the one-step manufacturing process by means of the overall soldering of the tube in the vacuum (one-shot method), is, among others, that one has a single production process, and not three, as in the conventional way: 1. soldering of components/2. joining of components (e.g. soldering or welding)/3. evacuation of the tube by means of vacuum pump. The one-step manufacturing method is therefore economically more efficient, time-saving and cheaper. At the same time, with suitable process control, contamination of the tubes can be minimized with this method. Anyhow it can be advantageous when the tube is free of impurities to a large extent which, as a rule, minimize the ceramic insulator's ability to withstand voltage. The requirements with respect to vacuum tightness for the tubes 10 are in most cases the same with one-shot methods as with multi-step manufacturing processes. Since the fields inside the tube 10 are much smaller than in the case of conventional tubes, the tube 10 according to the invention is moreover less vulnerable to impurities and/or leaks. This makes the X-ray tube 10 according to the invention further suitable for the one-shot method. The X-ray tube 10 according to the invention can be excellently used for manufacture of an entire irradiation system and/or for individual irradiation devices 60 (see FIG. 12). In such an irradiation device 60, the tube 10 can be stored in a housing 65, e.g. in insulating oil. The shield housing 65 can include an emission hole 61 for X-radiation γ. The irradiation device 60 comprises for the tube 10 a corresponding high voltage cascade 62, e.g. with an assigned high voltage transformer 63 and voltage connections 64 to the outside. Such irradiation devices 60 or monoblocks 60 can then be used e.g. for manufacture of larger irradiation systems. Of course it is clear to one skilled in the art in the field that the tube 10 according to the invention, without target or transmission anode, is also excellently suited as electron emitter and/or electron cannon with the corresponding industrial areas of application owing to its simple, modular construction and its high performance.

For the implementation according to the invention, it can be expedient for the shields 422/432/442 to be shaped such that the electron beam does not "see" any insulator surface 51 (FIG. 13). Charging effects of the ceramic insulators 51 can result through impression of the acceleration voltage, which effects do not necessarily have to be caused by stray and secondary electron emission. By means of a geometry shown in FIG. 13, or a similar geometry, such charging effects can be prevented or diminished. A coating of the ceramic insulator can also be used in particular for feed of the potential, if e.g. a suitable conductive coating is added outside on the insulators, so that the coating acts as voltage divider. A suitable coating against the vacuumized inner space could also replace the metallic electrodes 423/433/443. This would have the consequence, however, that one no longer has any shielding as in FIG. 13. As an embodiment example it would be possible e.g. to put a helical layer on the inner side (vacuum) of the ceramic insulator 51 acting as voltage divider, and thus replacing the series of metallic electrodes 423/433/443.

The invention claimed is:

1. An X-ray tube in which an anode and a cathode are disposed opposite each other in a vacuumized inner space, electrons being able to be produced at the cathode, being able to be accelerated to the anode by means of impressible high voltage, and X rays being able to be produced at the anode by means of the electrons, the X-ray tube comprising a multiplicity of mutually complementary acceleration modules, each acceleration module comprising at least one potential-carrying electrode, a first acceleration module comprising the cathode with electron extraction, and a second acceleration module comprising the anode with the X ray generation, wherein the X-ray tube comprises:

at least one further acceleration module with a potential-carrying electrode, the acceleration module for acceleration of electrons being repeatedly connectible in series as often as desired, and the X-ray tube being of modular construction, said at least one acceleration module being interposed between the first and second acceleration module with the respective cathode and anode.

2. The X-ray tube according to claim 1, wherein the difference in potential between each two potential-carrying electrodes of adjacent acceleration modules is constant for all acceleration modules, the final energy of the accelerated electrons being a whole-number multiple of the energy of an acceleration module.

3. The X-ray tube according to claim 2, wherein at least one of the acceleration modules has a reclosable vacuum valve and/or vacuum seals on one side or on two sides.

4. The X-ray tube according to claim 3, wherein the acceleration modules include a cylindrical ceramic insulator.

5. The X-ray tube according to claim 4, wherein the insulating ceramic has a high-ohmic interior coating.

6. The X-ray tube according to claim 5, wherein the ceramic insulator comprises a ridged exterior structure.

7. The X-ray tube according to claim 6, wherein the anode comprises a target for X-ray generation as well as an emission hole for X-radiation.

8. The X-ray tube according to claim 7, wherein the electrodes of the acceleration modules include a shield for suppression of the stray electron flow on the ceramic insulator.

9. The X-ray tube according to claim 8, wherein at least one of the electrodes and/or shields comprises spherically or conically designed ends for reducing or minimizing the field peak at the respective electrode and/or shield.

10. The X-ray tube according to claim 6, wherein the anode includes a transmission anode, the transmission anode closing off the vacuumized inner space toward the outside.

11. The X-ray tube according to claim 1, wherein at least one of the acceleration modules has a reclosable vacuum valve and/or vacuum seals on one side or on two sides.

12. The X-ray tube according to claim 1, wherein the acceleration modules include a cylindrical ceramic insulator.

13. The X-ray tube according to claim 12, wherein the insulating ceramic has a high-ohmic interior coating.

14. The X-ray tube according to claim 12, wherein the ceramic insulator comprises a ridged exterior structure.

15. The X-ray tube according to claim 1, wherein the anode comprises a target for X-ray generation as well as an emission hole for X-radiation.

16. The X-ray tube according to claim 1, wherein the anode includes a transmission anode, the transmission anode closing off the vacuumized inner space toward the outside.

17. The X-ray tube according to claim 1, wherein the electrodes of the acceleration modules include a shield for suppression of the stray electron flow on the ceramic insulator.

18. The X-ray tube according to claim 17, wherein at least one of the electrodes and/or shields comprises spherically or conically designed ends for reducing or minimizing the field peak at the respective electrode and/or shield.

19. An irradiation system, wherein the irradiation system comprises at least one X-ray tube in which an anode and a cathode are disposed opposite each other in a vacuumized inner space, electrons being able to be produced at the cathode, being able to be accelerated to the anode by means of impressible high voltage, and X rays being able to be produced at the anode by means of the electrons, the X-ray tube comprising a multiplicity of mutually complementary acceleration modules, each acceleration module comprising at least one potential-carrying electrode, a first acceleration module comprising the cathode with electron extraction, and a second acceleration module comprising the anode with the X ray generation, wherein the X-ray tube comprises at least one further acceleration module with a potential-carrying electrode, interposed between the first and second acceleration modules with the respective cathode and anode the acceleration module for acceleration of electrons being repeatedly connectible in series as often as desired, and the X-ray tube being of modular construction, said at least one X-ray tube having a high voltage cascade for voltage supply of the X-ray tube.

20. A method of production of an X-ray tube in which an anode and a cathode are disposed opposite each other in a vacuumized inner space, electrons being able to be produced at the cathode, being able to be accelerated to the anode by means of impressible high voltage, and X rays being able to be produced at the anode by means of the electrons, the X-ray tube comprising a multiplicity of mutually complementary acceleration modules, each acceleration module comprising at least one potential-carrying electrode, a first acceleration module comprising the cathode with electron extraction, and a second acceleration module comprising the anode with the X ray generation, wherein the X-ray tube comprises at least one further acceleration module with a potential-carrying electrode, interposed between the first and second acceleration modules with the respective cathode and anode, the acceleration module for acceleration of electrons being repeatedly connectible in series as often as desired, and the X-ray tube being of modular construction; wherein:

the X-ray tube (10) is produced in a one-step vacuum soldering process.

* * * * *